US007183986B2

(12) United States Patent
Seo et al.

(10) Patent No.: US 7,183,986 B2
(45) Date of Patent: Feb. 27, 2007

(54) DEVICE AND METHOD FOR IMPROVING A RADIATION PATTERN OF A MOBILE WIRELESS TERMINAL WITH A BUILT-IN ANTENNA

(75) Inventors: Ho-Soo Seo, Suwon-si (KR); Taig-Jong Yoo, Kunpo-si (KR); Jae-Joon Choi, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 28 days.

(21) Appl. No.: 11/182,318

(22) Filed: Jul. 15, 2005

(65) Prior Publication Data

US 2006/0022878 A1 Feb. 2, 2006

(30) Foreign Application Priority Data

Jul. 28, 2004 (KR) ..... 10-2004-0059053

(51) Int. Cl.
*H01Q 1/24* (2006.01)

(52) U.S. Cl. ..... 343/702; 343/846

(58) Field of Classification Search ..... 343/702, 343/846, 848, 700 MS
See application file for complete search history.

(56) References Cited

U.S. PATENT DOCUMENTS 6,963,310 B2 * 11/2005 Horita et al. ..... 343/702
2004/0222926 A1 * 11/2004 Kontogeorgakis et al. .. 343/702
2006/0125700 A1 * 6/2006 Kanazawa ..... 343/702

FOREIGN PATENT DOCUMENTS

KR 2004-0063235 7/2004

* cited by examiner

*Primary Examiner*—Hoanganh Le
(74) *Attorney, Agent, or Firm*—The Farrell Law Firm

(57) ABSTRACT

The present invention relates to a device and method for improving a radiation pattern of a built-in antenna in a folder-typed mobile wireless terminal that has a main body having the RF board installed with a built-in antenna, a sub-body to be opened and closed at an angle from the main body, and a hinge module configured to open and close the sub-body. The device includes a conductive ground means installed in the sub-body at a portion adjacent to the built-in antenna, for minimizing a radiation pattern difference of the built-in antenna between the opening and closing of the sub-body, thereby increasing reliability of the terminal.

12 Claims, 10 Drawing Sheets

DEVICE AND METHOD FOR IMPROVING A RADIATION PATTERN OF A MOBILE WIRELESS TERMINAL WITH A BUILT-IN ANTENNA

PRIORITY

This application claims priority to an application entitled "DEVICE AND METHOD FOR IMPROVING RADIATION PATTERN IN PORTABLE HANDHELD RADIOTELEPHONE WITH BUILT-IN ANTENNA" filed in the Korean Intellectual Property Office on Jul. 28, 2004 and assigned as Serial No. 10-2004-0059053, the contents of which are incorporated herein by reference.

BACKGROUND OF THE INVENTION

1. Field of the Invention

The present invention relates generally to a folder-typed mobile wireless terminal with a built-in antenna in a main body thereof, and more particularly, to a device and method for improving a radiation pattern of a built-in antenna in a mobile wireless terminal, in which the built-in antenna is designed to have a constant radiation pattern and gain, regardless of whether a folder of the terminal is opened or closed.

2. Background of the Invention

Recently, a mobile wireless terminal such as a Personal Communication System (PCS), Digital Cellular System (DCS), Global Positioning System (GPS), Personal Digital Assistant (PDA), cellular phone, or wireless notebook has become popularized, and terminals with various functions and designs have been introduced. Further, small-sized, slim, and lightweight terminals have been introduced. Additionally, these terminals are required to have various functions. Therefore, the design of the terminal is focused on volume reduction while maintaining or improving the functions, for a customer satisfaction.

More specifically, a rod antenna (or whip antenna) or a helical antenna that is protruded outward from the terminal is easy to break when the terminal is dropped, and the antenna lowers the mobility of the terminal. Therefore, a plate-type antenna installed within the terminal, i.e., a built-in antenna, internal antenna, or intenna, is now used and various efforts are made to improve the performance and productivity of the built-in antenna.

Generally, the built-in antenna is electrically connected to a radio frequency (RF) board of a terminal main body by connecting directly or using a cable, such as a flexible printed circuit (FPC), to space the antenna away from the RF board. When the built-in antenna is directly connected to the RF board, the built-in antenna is connected to ground means such as a pin connector that is protruded upward from the RF board of the terminal main body.

However, when calling with a folder-typed wireless terminal, a folder (sub-body) should be opened at a predetermined angle from the terminal main body. As a result, the folder-typed mobile wireless terminal with a built-in antenna has a disadvantage of deteriorating call quality and lowering reliability because a radiation pattern of the antenna becomes different according to an opening and closing of the folder of the terminal. An attempt to avoid spurious occurrence and radiation has been made by entirely or partially spraying a conductive material inside of a frame of the terminal. However, there is still a problem in that the opening and closing of the terminal influences the radiation pattern of the built-in antenna of the terminal.

SUMMARY OF THE INVENTION

Accordingly, the present invention is directed to a device and method for improving a radiation pattern of a built-in antenna in a folder-typed mobile wireless terminal, which substantially obviates the above and other problems due to limitations and disadvantages of the related art.

An object of the present invention is to provide a device and method for improving a radiation pattern of a built-in antenna in a folder-typed mobile wireless terminal, the device and method making the radiation pattern constant regardless of opening and closing of the terminal.

Another object of the present invention is to provide a device and method for improving a radiation pattern of a built-in antenna in a folder-typed mobile wireless terminal, the device and method sharply reducing the radiation gain and efficiency differences between the opening and closing operations of the terminal.

Further, another object of the present invention is to provide a device and method for improving a radiation pattern of a built-in antenna in a folder-typed mobile wireless terminal, the device and method increasing a field efficiency.

Yet another object of the present invention is to provide a device and method for improving a radiation pattern of a built-in antenna in a folder-typed mobile wireless terminal, the device and method providing a ground means around the built-in antenna, for minimizing a radiation pattern difference between opening and closing operations of a folder, thereby increasing call quality and a user's reliability.

To achieve the above and other objects and advantages, according to an aspect of the present invention, there is provided a method for improving a radiation pattern of a built-in antenna in a folder-typed mobile wireless terminal that has a main body having an RF board installed with a built-in antenna, a sub-body to be opened and closed at a predetermined angle from the main body, and a hinge module configured to open and close the sub-body at the angle from the main body. The method includes installing a conductive ground means in the sub-body at a portion adjacent to the built-in antenna, for minimizing a radiation pattern difference of the built-in antenna between the opening and closing of the sub-body, thereby increasing reliability of the terminal.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Also, when it is determined that the subject of the invention may be obscured by a detailed description, the detailed description will be omitted.

Figure 1:
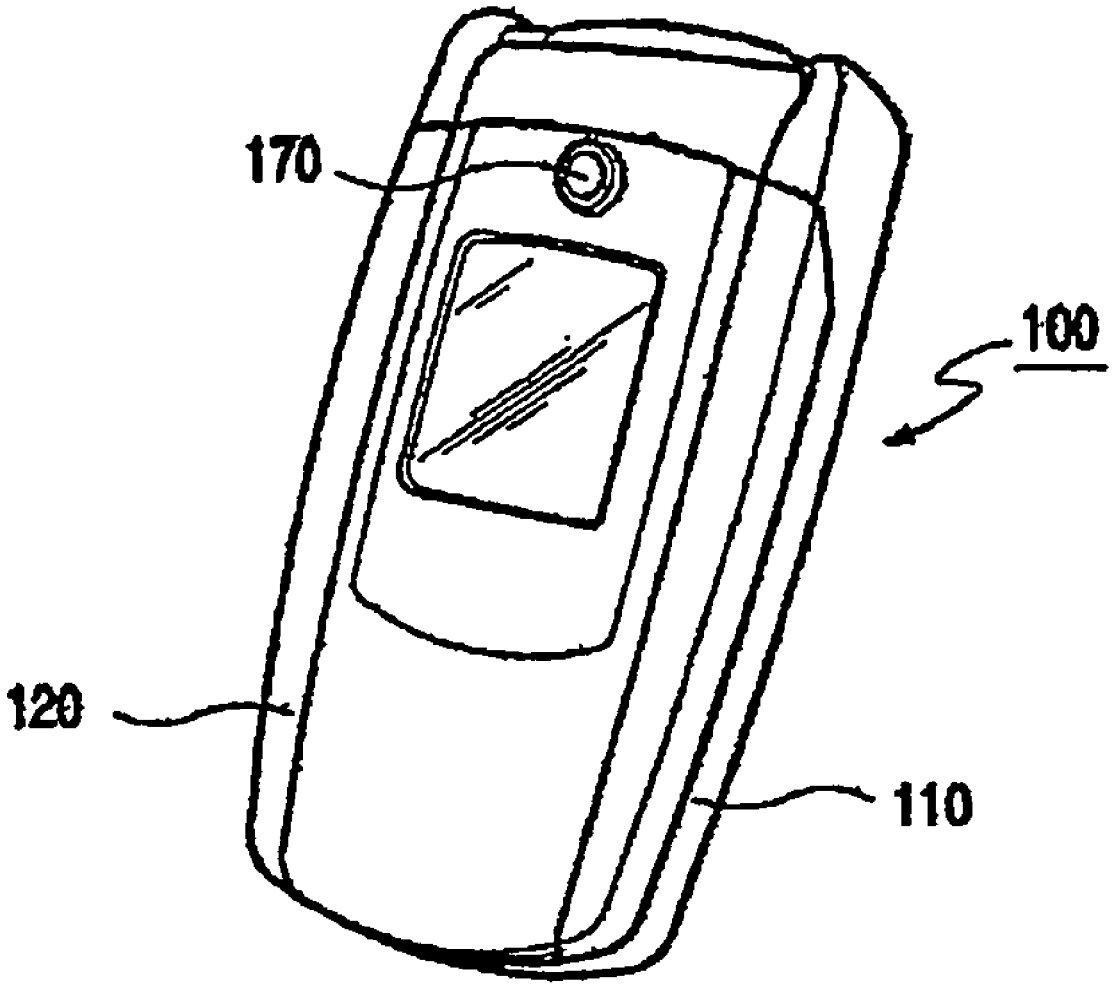
FIG. 1 PRIOR ART
FIG. 1 is a perspective view of a conventional folder-typed mobile wireless terminal with a built-in antenna.
Figure 2:
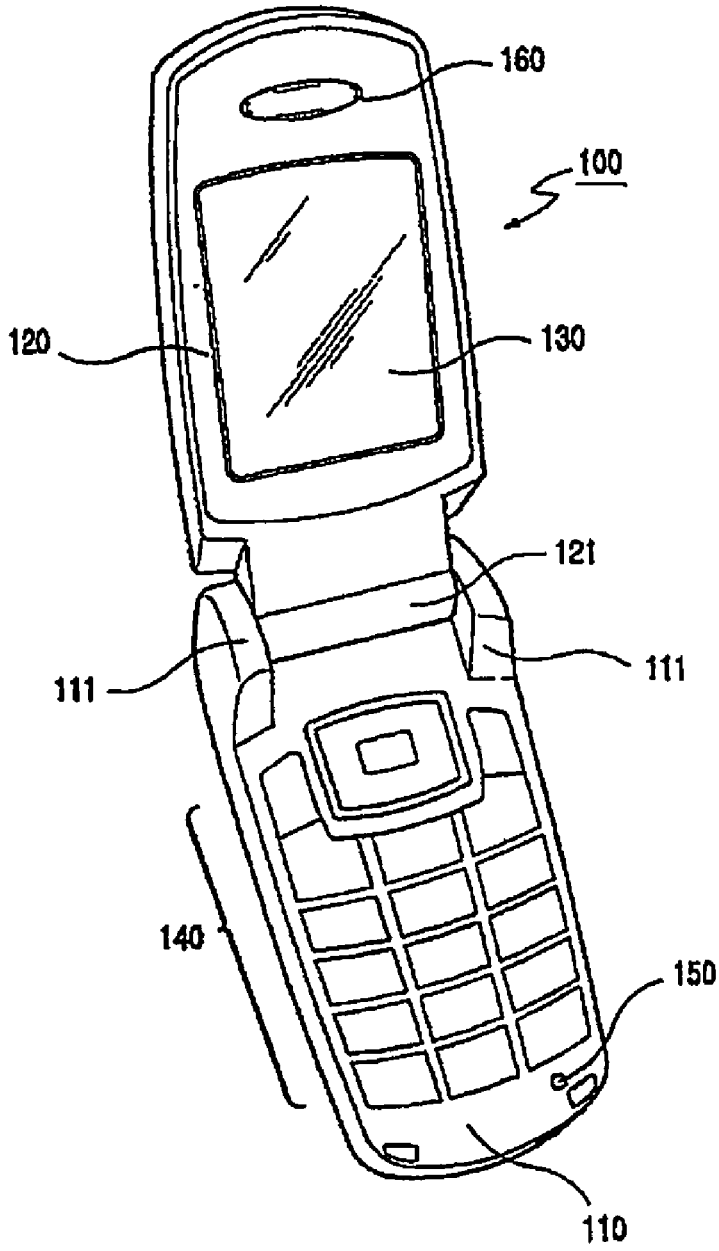
FIG.2 PRIOR ART
FIG. 2 is a perspective view illustrating a mobile wireless terminal depicted in FIG. 1 when a folder is opened.
Figure 3:
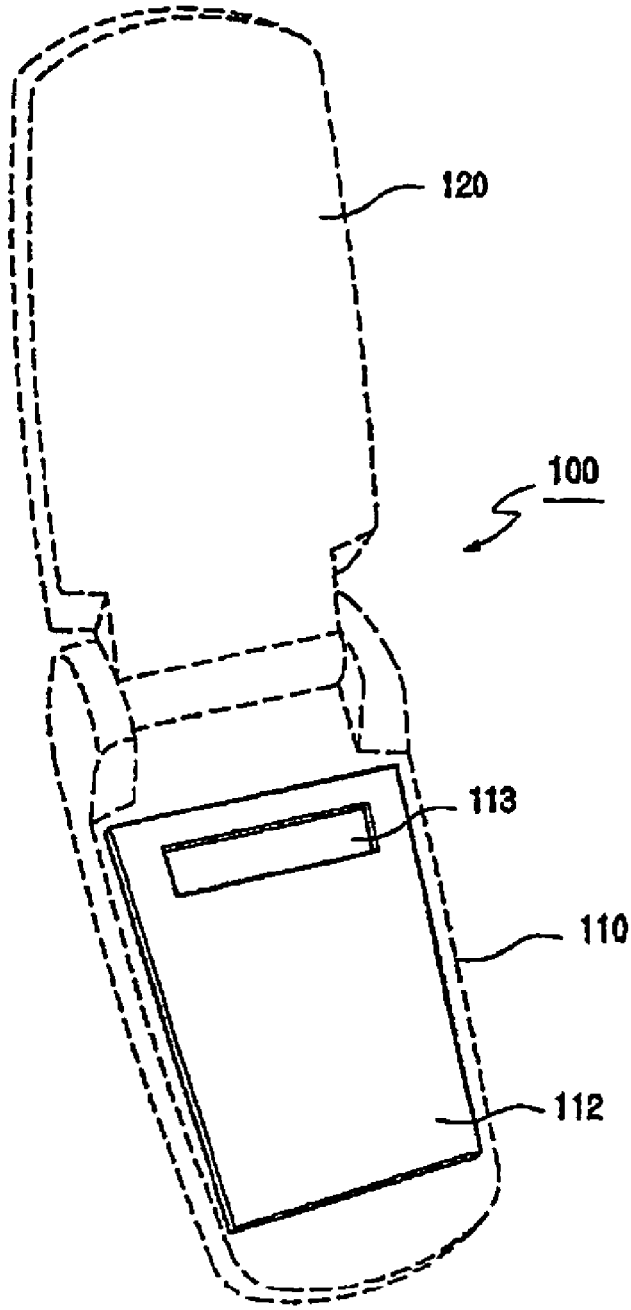
FIG.3 PRIOR ART
FIG. 3 is a view schematically illustrating the position of an antenna in a mobile wireless terminal depicted in FIG. 2.

FIG. 1 is a perspective view illustrating a conventional folder-typed mobile wireless terminal with a built-in antenna. FIG. 2 is a perspective view illustrating the mobile wireless terminal depicted in FIG. 1 when a folder is opened. FIG. 3 is a view schematically illustrating a position of an antenna in the mobile wireless terminal depicted in FIG. 2.

Referring to FIGS. 1 to 3, a conventional folder-typed mobile wireless terminal with a built-in antenna includes: a main body 110; a folder 120 that is rotatably coupled to the main body 110 for opening and closing operations at a predetermined angle; and a hinge module (refer to 180 in FIG. 4) configured to open and close the folder 120 at the predetermined angle (usually about 130° through 140°) from the main body 110. The hinge module 180 includes a hinge shaft in a hinge housing 181 (refer to 181 in FIG. 4), a hinge cam engaged with the hinge shaft, and a hinge spring biasing the hinge cam against the hinge shaft. The hinge module 180 is accommodated in the hinge housing 181 as an assembly and installed in the main body 110 or a boundary portion of the folder 120. The hinge housing 181 is preferably made of metal for durability.

In this embodiment, the hinge module is installed in a center hinge arm of the folder 120 (sub-body), and a shaft head protruded from an end of the hinge module 180 is coupled to one of the hinge arms formed at both sides of main body 110, for the opening and closing operations of the terminal.

The main body 110 includes a keypad assembly 140, having navigation key buttons as a data input means, and a microphone 150 as a sender below the keypad assembly to send a voice. Further, the folder 120 includes a display 130, preferably, a wide color LCD module, as a data output means, and a speakerphone 160 as a receiver above the display 130 to receive a voice. Furthermore, the folder 120 may include a slave LCD module at its outer surface and a camera 170 for photographing an object above the slave LCD module. A terminal 100 of the present invention utilizes a built-in antenna accommodated therein, and thereby, the antenna of the terminal 100 is not protruded outwardly.

Referring to FIG. 3, the main body 110 of the terminal 100 includes an RF board 112 and a built-in antenna 113 on the RF board 112. The built-in antenna 113 may be formed into various plate shapes. The shape of the built-in antenna 113 may be formed into other efficient shapes according to shape, size, operating frequency, and other features of the terminal 100.

Figure 4:
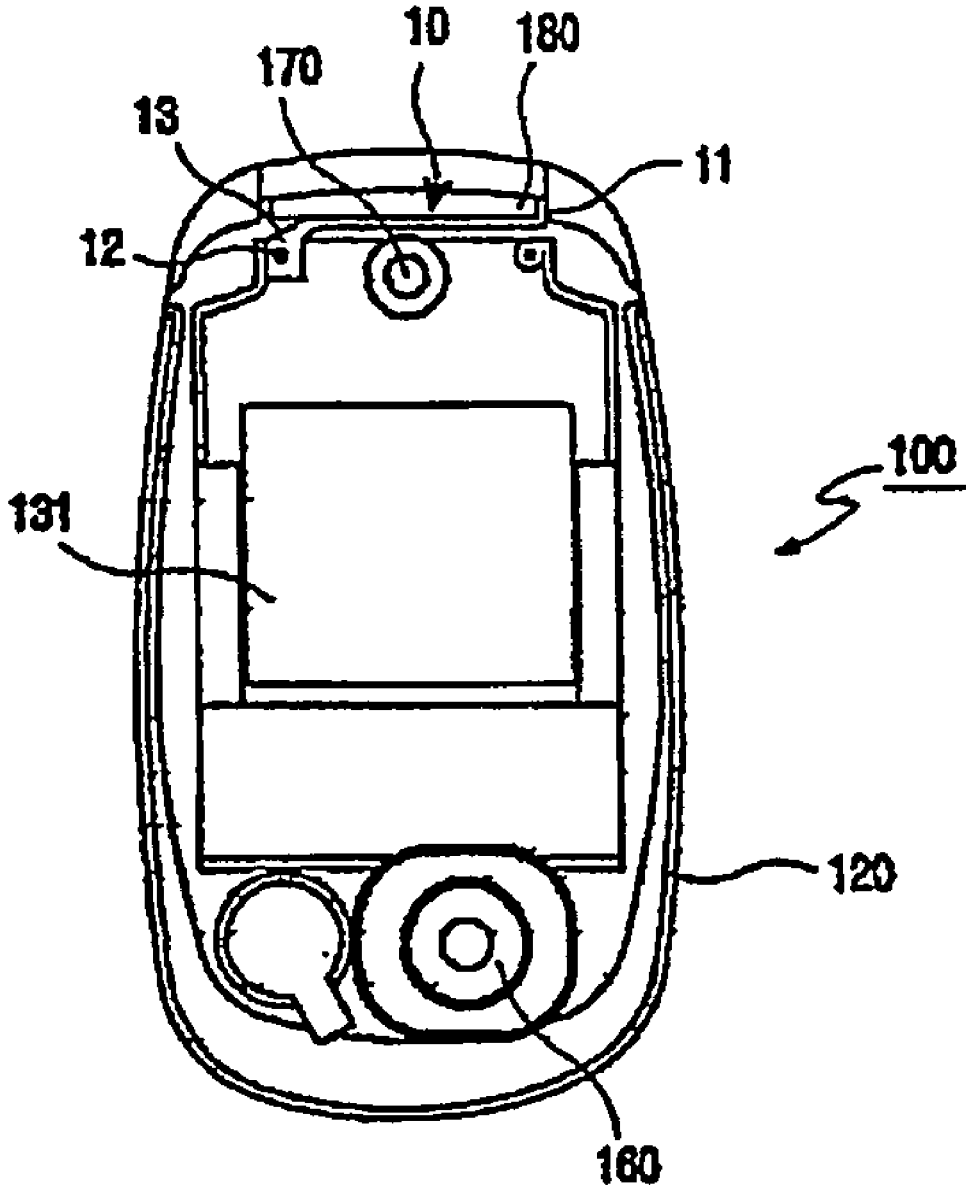
FIG. 4 is a plan view illustrating a folder in which a ground plate is disposed to improve a radiation property of a built-in antenna in a mobile wireless terminal according to the present invention.
Figure 5:
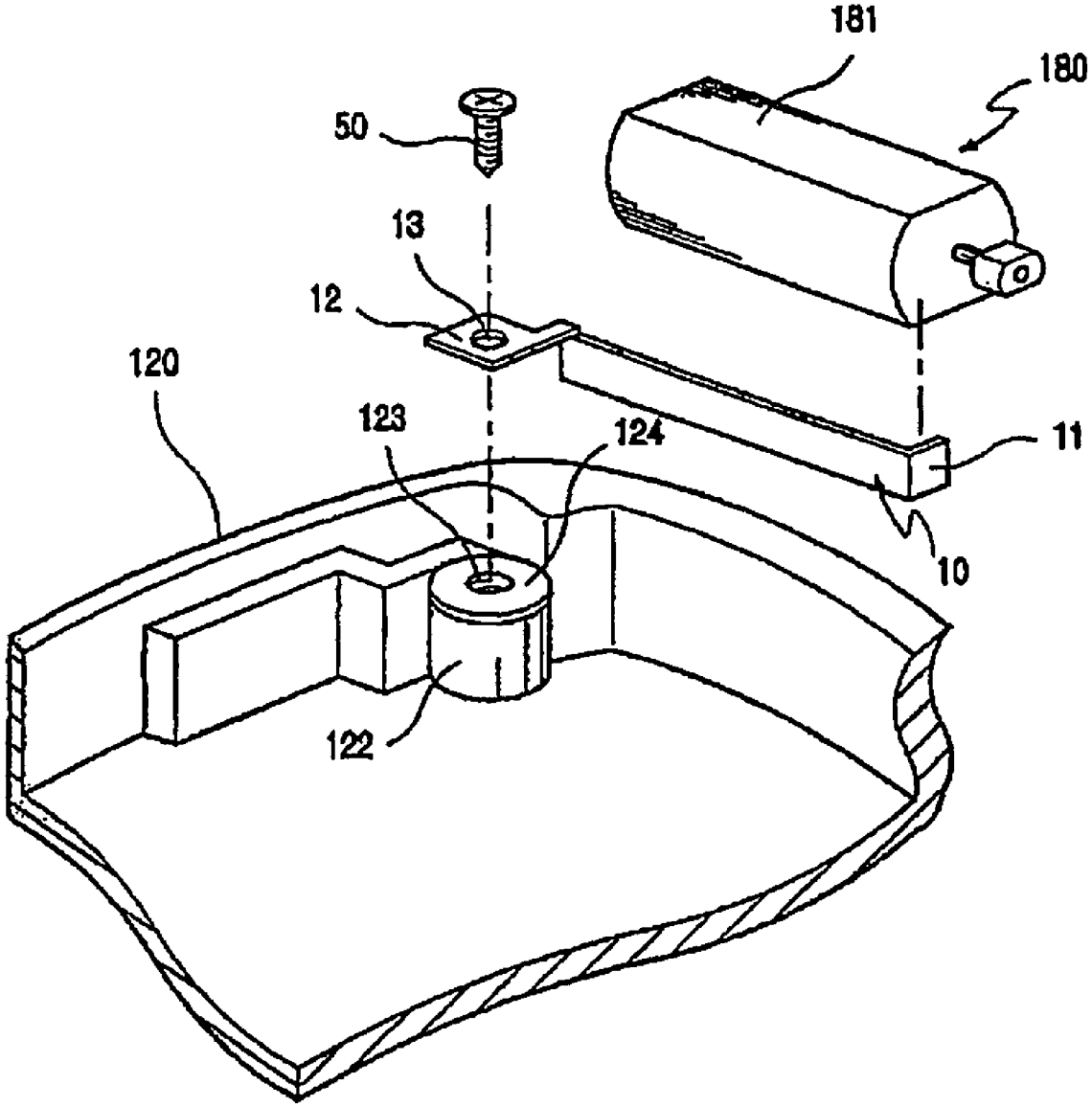
FIG. 5 is a partial exploded perspective view illustrating an end of a ground plate that is connected to a terminal coupling bushing according to an embodiment of the present invention.

FIG. 4 is a plan view of a folder in which a ground plate is disposed to improve a radiation property of a built-in antenna in a mobile wireless terminal according to the present invention, and FIG. 5 is a partial exploded perspective view illustrating an end of a ground plate being connected to a terminal coupling bushing according to an embodiment of the present invention.

Referring to FIGS. 4 and 5, a conductive ground means of the present invention is installed at a portion adjacent to the hinge module 180 in the folder 120, preferably parallel with the longitudinal direction of the hinge module 180. A metal plate is used for the conductive ground means in FIGS. 4 and 5. The metal plate 10 may be made of copper, aluminum, stainless steel, or the like, and is preferably formed having a proper length according to the kind and shape of the terminal 100.

The metal plate 10 includes a body, a ground end 11 bent toward the hinge module 180, and the other ground end 12 at the opposite position to the ground end 11, which are formed integrally. The ground end 11 is contacted with the metal hinge housing 181, for an electrical grounding. The ground end 12 of the metal plate 10 is grounded to a bushing 122 disposed in the folder 120. The bushing 122 is a coupling means to which a case frame of the folder 120 is coupled. A coupling part 123 made of conductive metal may be insert-molded into the bushing 122, for coupling with a screw 50. Preferably, a metal ring 124 is added on the top of the bushing, in order to provide a more reliable electrical connection between the ground end 12 and the bushing 122. Further, through hole 13 is formed in the ground end 12, for an insertion of the screw 50.

Figure 7A:
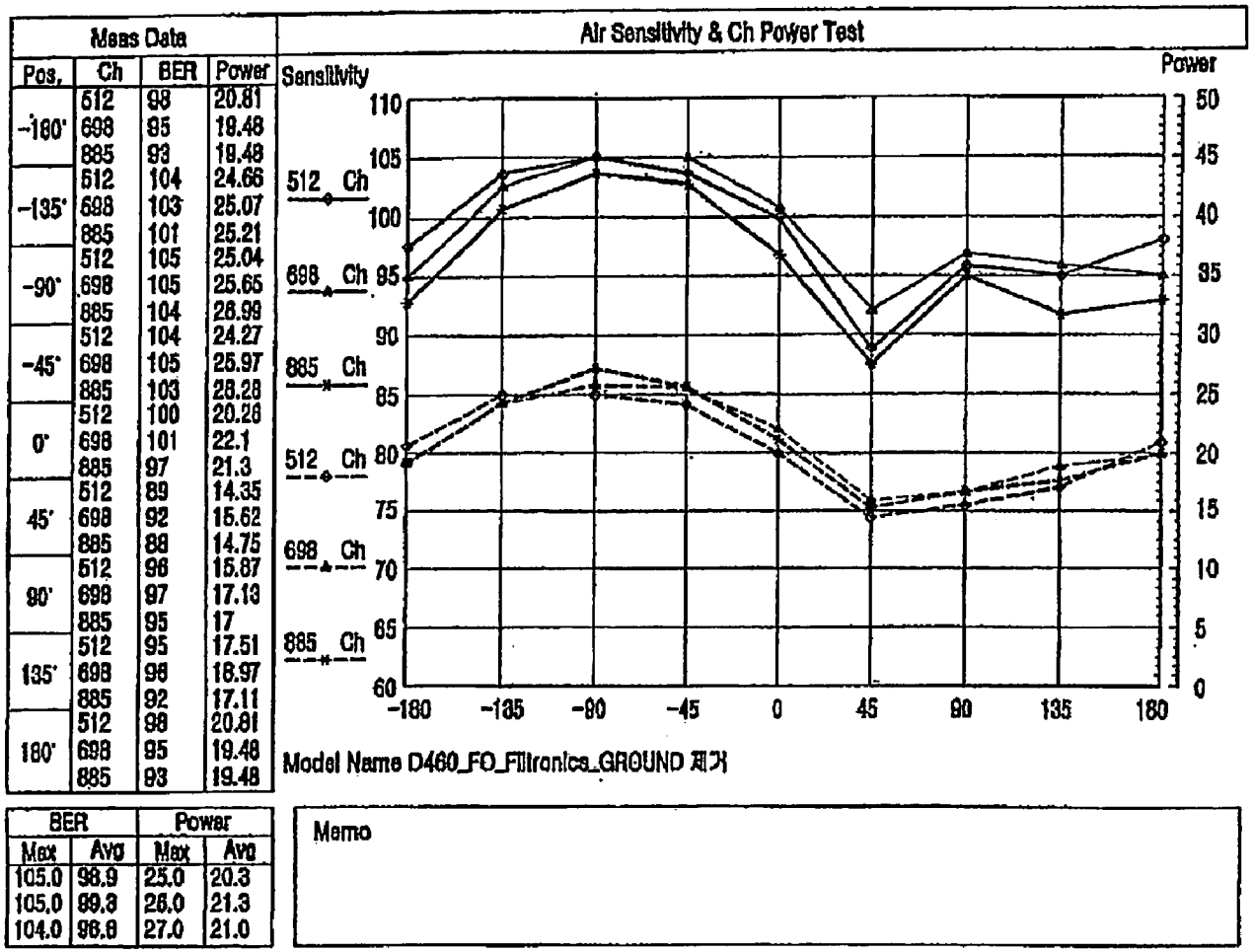
FIGS. 7A and 7B are graphs illustrating radiation patterns according to an opening and closing of a mobile wireless terminal when a ground plate of the present invention is not employed.
Figure 7B:
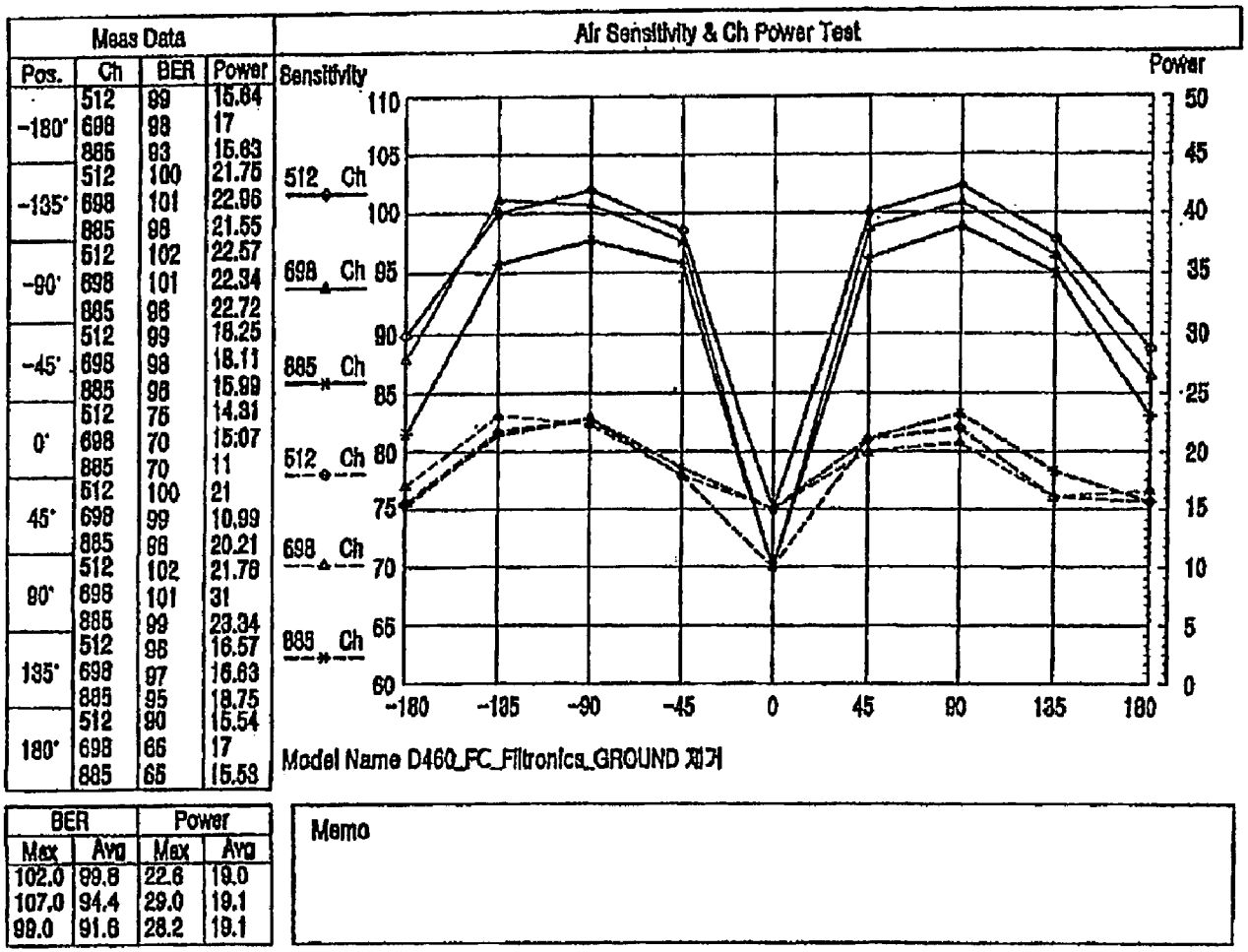
Figure 8A:
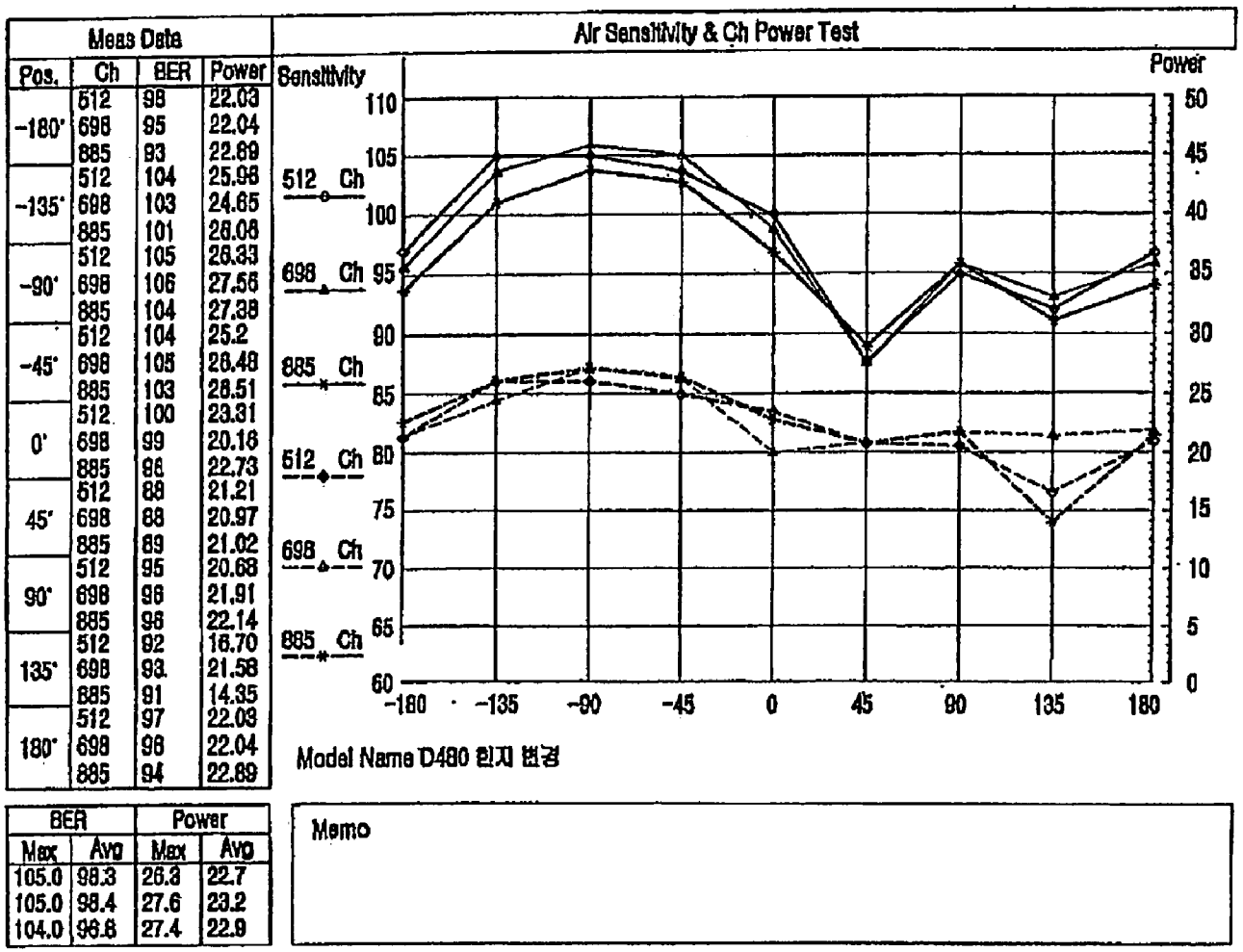
FIGS. 8A and 8B are graphs illustrating radiation patterns according to an opening and closing of a mobile wireless terminal when a ground plate of the present invention is employed.
Figure 8B:
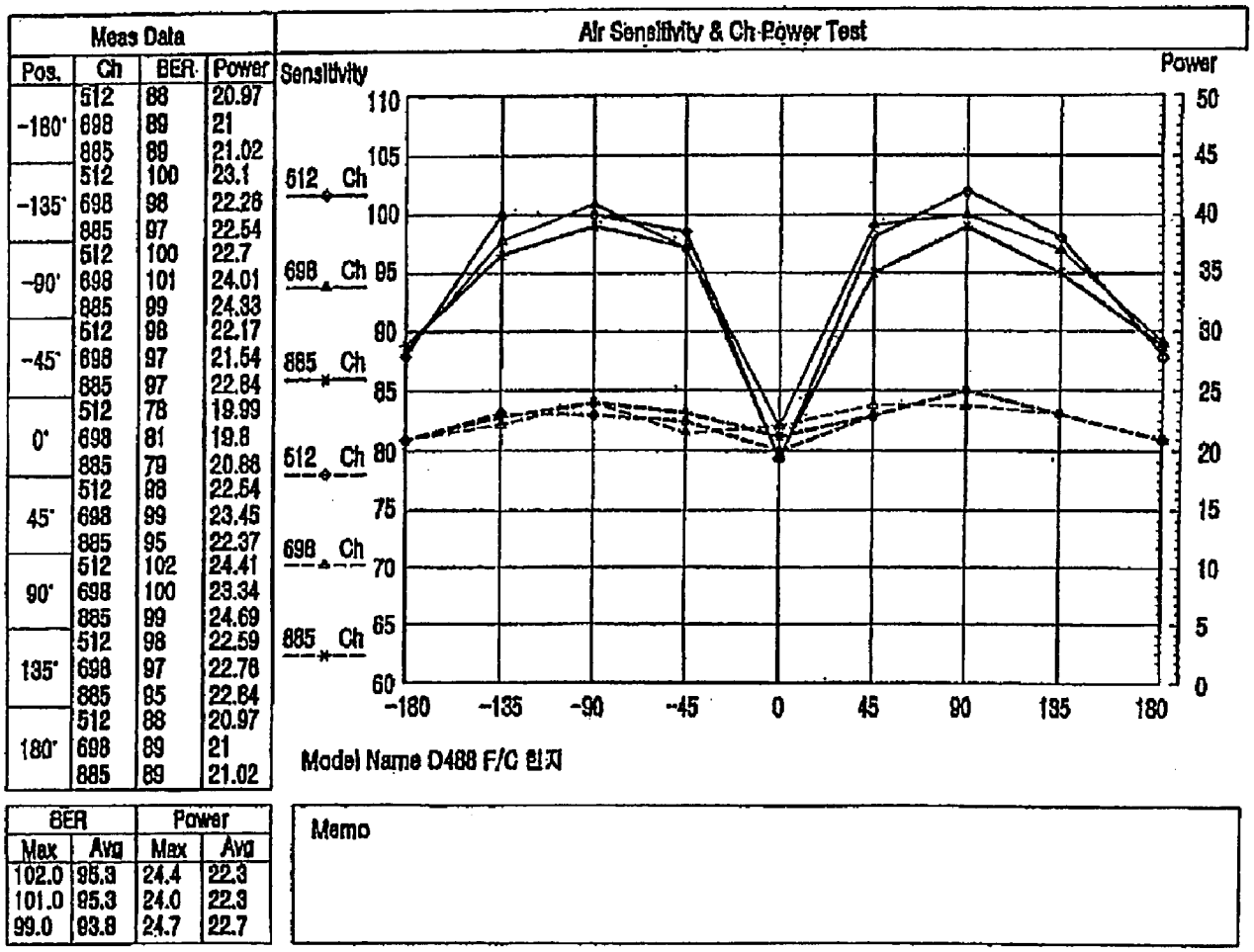

FIGS. 7A and 7B are graphs showing the radiation patterns according to an opening and closing of a mobile wireless terminal when a metal plate of the present invention is not employed. FIGS. 8A and 8B are graphs showing the radiation patterns according to an opening and closing of a mobile wireless terminal when a metal plate of the present invention is employed.

Referring to FIGS. 7A through 8B, the graphs illustrate experimental results according to no use and use of the ground means of the present invention, and the experiment was performed in DCS band. Therefore, the length of metal ground plate 10 was adjusted according to the DCS band.

Further, the experimental results show that the metal plate 10 of the present invention is more effective when used in GSM 1800 band than in GSM 900 band because the terminal 100 has more radiation pattern change in GSM 1800 than in GSM 900 when the folder 120 is opened and closed.

The experimental results illustrated in FIGS. 7A through 8B are summarized in table 1 below. For example, received powers are now compared. The terminal without the ground means has received power of −105 to −87 dBm when the folder 120 is opened and −102 to −70 dBm when the folder 120 is closed, with a maximum difference of 17 dBm between the opened and closed states. However, the terminal with the ground means has received power of −106 to −88 dBm when the folder 120 is opened and −102 to −78 dBm when the folder 120 is closed, with a maximum difference of 10 dBm between the opened and closed states. That is, the ground means of the present invention sharply reduces the received power difference between the opened and closed states and reduces the change of radiation pattern between the opened and closed states.

TABLE 1

| | Folder open | | Folder closed | |
|---|---|---|---|---|
| | TX (Max/Min) dBm | RX (Max/Min) dBm | TX (Max/Min) dBm | RX (Max/Min) dBm |
| Conventional art | 27/14 | −105/−87 | 23.2/15 | −102/−70 |
| Present invention | 27.6/17 | −106/−88 | 24.7/20 | −102/−78 |

Figure 6:
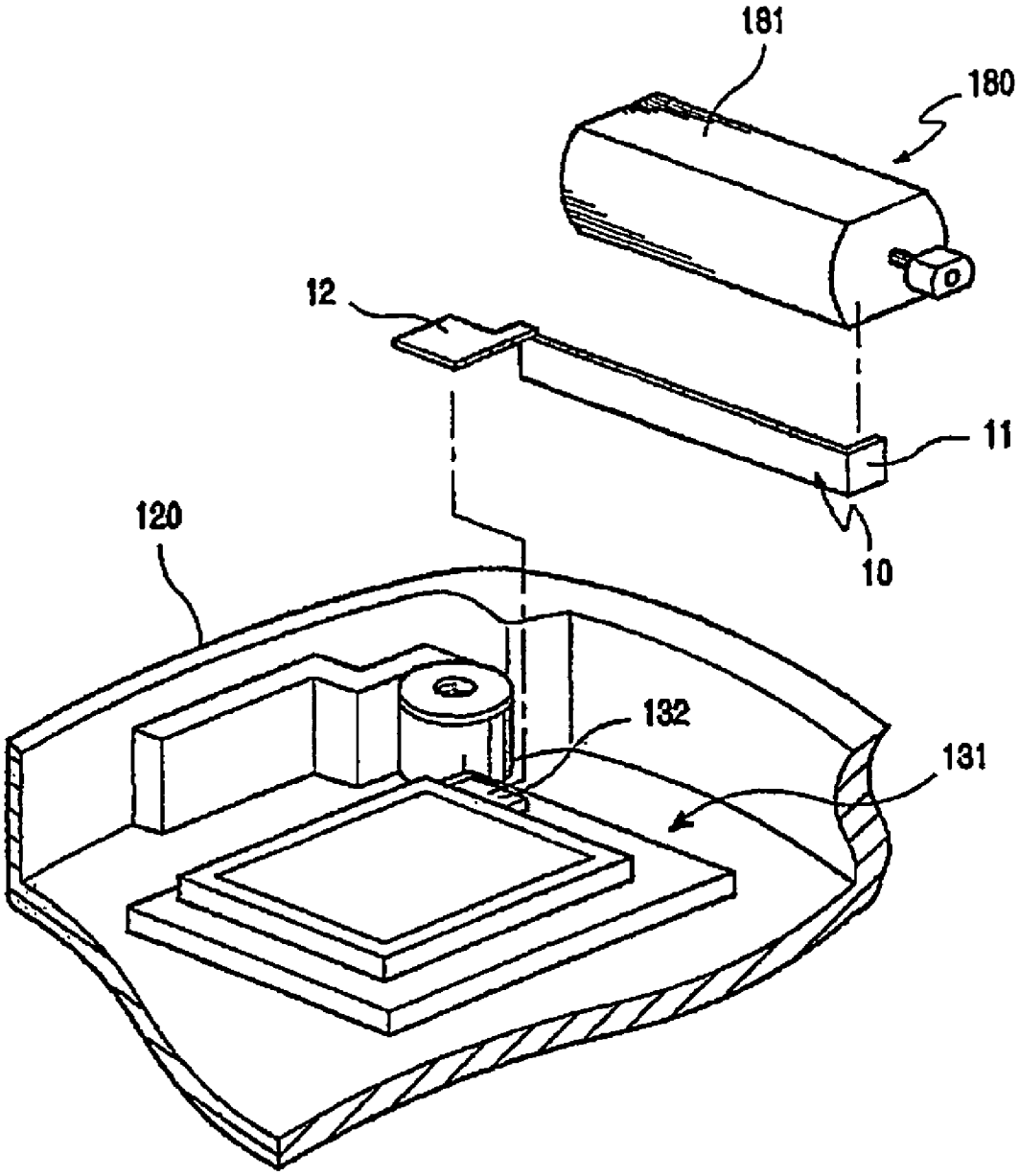
FIG. 6 is a partial exploded perspective view illustrating an end of a ground plate connected to an LCD module of a mobile wireless terminal according to another embodiment of the present invention.

FIG. 6 is a partial exploded perspective view illustrating an end of a ground plate that is connected to an LCD module of a mobile wireless terminal according to another embodiment of the present invention. Referring to FIG. 6, the ground end 12 of the metal plate 10 may be electrically connected with a ground part 132 on an LCD module 131 of the folder 120, by soldering, bonding, connecting, etc.

The ground end 12 of the metal plate 10 may be electrically grounded to a strip finger (not shown) that is well known in the related art as a barrier rib capable of shielding electromagnetic wave of electronic function groups in the folder. Further, a sprayed conductive layer in the folder 120 may electrically ground the ground end 12 of the metal plate 10. Further, the ground end 11 of the metal plate 10 is contacted to the metal hinge housing 181 of the hinge module 180, but in some cases, it may be grounded to an end of a metal hinge pin of the hinge module 180.

As described above, the present invention utilizes the conductive ground means around the built-in antenna of the mobile wireless terminal, such that the radiation property (pattern) difference of the built-in antenna can be sharply reduced between the opened and closed states of the folder, thereby improving a call quality of the mobile wireless terminal.

The forgoing embodiments are merely exemplary and are not to be construed as limiting the present invention. The present teachings can be readily applied to other types of apparatuses. The description of the present invention is intended to be illustrative, and not to limit the scope of the claims. Accordingly, many alternatives, modifications, and variations will be apparent to those skilled in the art.

What is claimed is:

1. A device for improving a radiation pattern of a built-in antenna in a folder-typed mobile wireless terminal including a main body having an RF (Radio Frequency) board installed with the built-in antenna, a sub-body to be opened and closed at a predetermined angle from the main body, and a hinge module configured to open and close the sub-body, the device comprising:

a conductive ground means installed in the sub-body at a portion adjacent to the built-in antenna, which is ground to a peripheral conductive structure, such that the built-in antenna has a minimized radiation pattern difference between the opening and closing of the sub-body.

2. The device of claim 1, wherein the conductive ground means is installed in parallel with a longitudinal direction of the hinge module.

3. The device of claim 1, wherein the conductive ground means is made of one of a conductive metal plate, an FPC (flexible printed circuit), and conductive tape, each having a predetermined length.

4. The device of claim 1, wherein a first end of the conductive ground means is grounded to a metal hinge housing of the hinge module and a second end of the conductive ground means is grounded to a metal coupling bushing that is used as a coupling means for a case frame of the sub-body.

5. The device of claim 1, wherein a first end of the conductive ground means is grounded to a metal hinge housing of the hinge module and a second end of the conductive ground means is grounded to a ground part of an LCD module of the sub-body.

6. The device of claim 1, wherein a first end of the conductive ground means is grounded to a metal hinge housing of the hinge module and a second end of the conductive ground means is grounded to a metal strip finger that is installed at an inner frame of the sub-body.

7. A method for improving a radiation pattern of a built-in antenna in a folder-typed mobile wireless terminal including a main body having an RF (Radio Frequency) board installed with the built-in antenna, a sub-body to be opened and closed at a predetermined angle from the main body, and a hinge module configured to open and close the sub-body, the method comprising:

installing a conductive ground means in the sub-body at a portion adjacent to the built-in antenna, for minimizing a radiation pattern difference of the built-in antenna between the opening and closing of the sub-body, thereby increasing reliability of the terminal.

8. The method of claim 7, wherein the conductive ground means is installed in parallel with a longitudinal direction of the hinge module.

9. The method of claim 7, wherein the conductive ground means is made of one of a conductive metal plate, an FPC (flexible printed circuit), and conductive tape, each having a predetermined length.

10. The method of claim 7, wherein a first end of the conductive ground means is grounded to a metal hinge housing of the hinge module and a second end of the conductive ground means is grounded to a metal coupling bushing that is used as a coupling means for a case frame of the sub-body.

11. The method of claim 7, wherein a first end of the conductive ground means is grounded to a metal hinge housing of the hinge module and a second end of the conductive ground means is grounded to a ground part of an LCD module of the sub-body.

12. The method of claim 7, wherein a first end of the conductive ground means is grounded to a metal hinge housing of the hinge module and a second end of the conductive ground means is grounded to a metal strip finger that is installed at an inner frame of the sub-body.

* * * * *